US005273176A

United States Patent [19]

Diaz

[11] Patent Number: 5,273,176

[45] **Date of Patent: * Dec. 28, 1993**

[54] RECLOSABLE COVER FOR A BEVERAGE CAN

[76] Inventor: Eusebio M. Diaz, 6450 Balboa Blvd., Van Nuys, Calif. 91406

[ * ] Notice: The portion of the term of this patent subsequent to Aug. 18, 2009 has been disclaimed.

[21] Appl. No.: 24,336

[22] Filed: Mar. 1, 1993

[51] Int. Cl.[5] ..... B65D 51/22

[52] U.S. Cl. ..... 220/258; 220/259; 220/718; 220/276; 220/375

[58] Field of Search ..... 220/259, 256, 257, 258, 220/254, 746, 717, 718, 729, 713, 276, 375

[56] References Cited

U.S. PATENT DOCUMENTS

| | | | |
|---|---|---|---|
| 3,419,181 | 12/1968 | Stec | 220/258 |
| 4,717,039 | 1/1988 | Ayyoubi | 220/258 X |
| 4,938,379 | 3/1990 | Kellner | 220/713 X |
| 4,948,009 | 8/1990 | Sawatani | 220/254 X |
| 5,139,163 | 8/1992 | Diaz | 220/259 X |

*Primary Examiner*—Allan N. Shoap
*Assistant Examiner*—Paul A. Schwarz
*Attorney, Agent, or Firm*—Roger A. Marrs

[57] ABSTRACT

A reclosable cover is disclosed herein for temporarily sealing and covering the open top of a beverage can which includes a cover body or disc having a downwardly depending peripheral flange with a connecting hinge secured to the sidewall of the beverage can. The cover body includes a circular recess adjacent to the flange adapted to permit nesting or stacking with the bottom of another can. The cover body further includes a weakened portion permitting the passage of a straw. The flange terminates in an inwardly disposed end portion for tightly sealing with the can and also provides for releasable retention of the body cover with the can.

1 Claim, 1 Drawing Sheet

RECLOSABLE COVER FOR A BEVERAGE CAN

BACKGROUND OF THE INVENTION

1. Field of the Invention

The present invention relates to the field of container closures, and more specifically to a novel beverage and food container having improved sealing and stackability features.

2. Brief Description of the Prior Art

In the past, it has been the conventional practice to provide temporary lids or covers for beverage cans which purport to seal the can before use and after use. Problems and difficulties have been encountered with such devices such as disclosed in U.S. Pat. No. 5,139,163 that stem largely from the fact that sealing is questionable after the opening of a can, as well as proper positioning for stacking in the event a plurality of the containers are stacked or nested together. Also, no means are provided for the use of a straw in order to extract the fluid content of the container.

Therefore, a long-standing need has existed to provide a novel hygienic seal and cover for a food and drink container which may be readily attached to the can and will accommodate stacking of several cans together without interference, and which when initially opened, can be subsequently closed and resealed to prevent contamination of the contents. Furthermore, means may be provided to permit easier opening by the user without the necessity of resorting to special latches or the like.

SUMMARY OF THE INVENTION

Accordingly, the above problems and difficulties are overcome by the present invention which provides a novel hygienic seal and cover for food and beverage containers, which includes a disc or cover body which incorporates an integral hinge which is fixedly attached or secured to the side of a beverage can. The cover body or disc includes a downwardly depending peripheral flange having an inwardly projecting sealing lip that provides a seal with the top of the can when the body cover is in its closed position. The cover body further includes a shaped recess adjacent to the downwardly depending flange which accommodates placement of the bottom of another can so that stackability of the cans is provided with stability. In one form of the invention, a weakened area of the cover body is included so that a drinking straw may be forced through the material and through the opening of the top of the container so that the lid, although sealed about the top of the can, will permit extraction of the liquid contents through the straw.

Therefore, it is among the primary objects of the present invention to provide a novel hygienic seal for food and drink containers which is hingeably attached to the side of the container and which is not separated from the container during use so that it may be employed for resealing after initial opening.

Another object of the present invention is to provide a novel cover for a beverage can so that the liquid contents may be readily extracted from the container without total removal of the sealed lid from the container.

Yet another object of the present invention is to provide a novel sealed cover or lid for a beverage can which offers improved sealing capabilities and permits a plurality of cans having the cover in the sealed position rendered stackable so that cans may be nested together for transportation and shipping purposes.

Still a further object of the present invention is to provide a novel beverage can cover which is hingeably supported on the sidewall of a beverage can and which may be opened and closed without removal from the can itself, and which further offers improved sealing capabilities when the cover is closed.

BRIEF DESCRIPTION OF THE DRAWINGS

The features of the present invention which are believed to be novel are set forth with particularity in the amended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
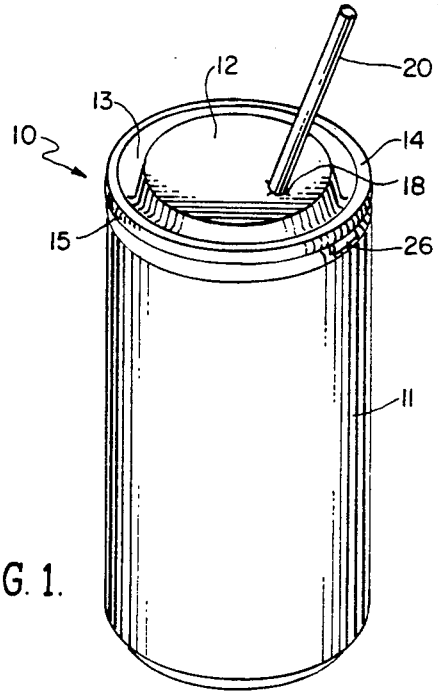
FIG. 1 is a front perspective view of a typical beverage can incorporating the novel seal and cover of the present invention.

Referring to FIG. 1, a hygienic seal and cover for food and drink containers is illustrated in the general direction of arrow 10, which is illustrated as being mounted on the top of a conventional "pop-top" can 11. The combined seal and cover includes a cover body 12 having a central raised area surrounded by a recess or groove 13 of circular configuration in plan view and which further includes a shoulder 14 which supports a downwardly depending sealing flange 15.

Figure 2:
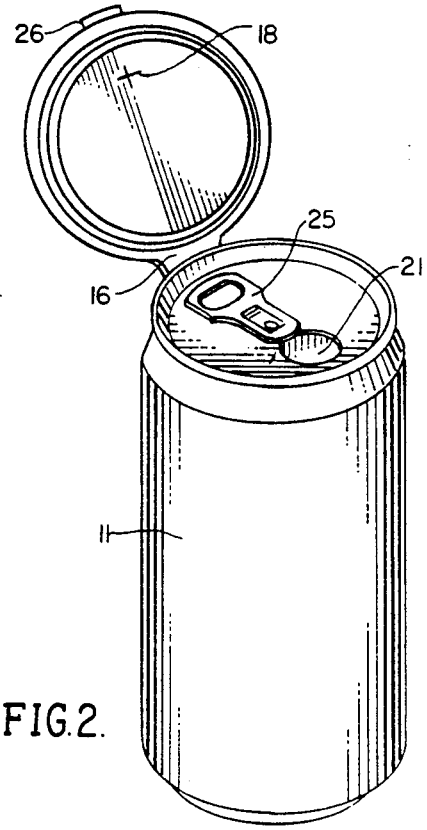
FIG. 2 is a view similar to the view of FIG. 1 illustrating the cover in a raised or open position.
Figure 3:
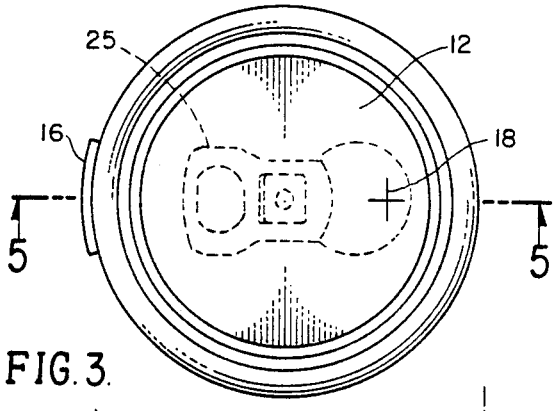
FIG. 3 is an enlarged top plan view of the cover or lid shown in FIGS. 1 and 2.
Figure 4:
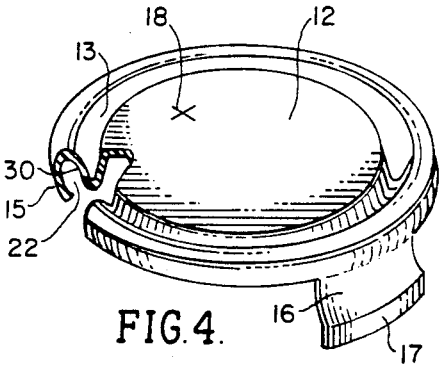
FIG. 4 is a rear perspective view of the cover, partially broken away, so as to illustrate the improved sealing feature.

As illustrated more clearly in FIG. 2, the cover body includes a hinge 16 which is integrally formed with the cover body and is secured to the sidewall of can 11 by means of a suitable attachment at an attachment area which is flat, as shown in FIG. 4. Numeral 17 indicates the attachment area while numeral 16 indicates a flexible hinge which is not attached to the sidewall of the container. FIGS. 2 and 3 further illustrate that the central area of the cover body includes a weakened area 18 which may consist of crossed slits so that a straw 20 may be projected therethrough and through an opening 21 in the top of the can 11 after the pop-top has been opened. As seen in FIG. 1, the straw may be used while the container is substantially sealed by the flange 15 during use.

Figure 5:
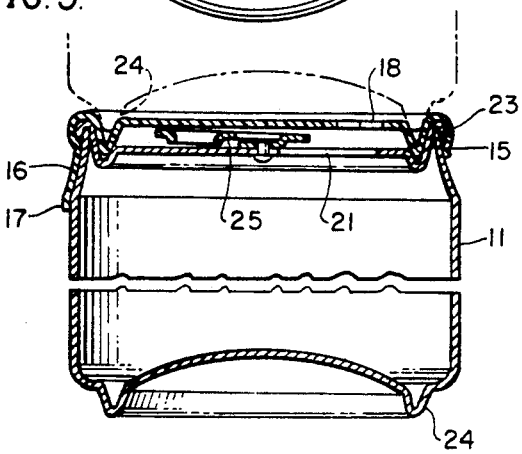
FIG. 5 is a transverse cross-sectional view of the beverage can and cover or lid as taken in the direction of arrows 5—5 of FIG. 3.

Referring now in detail to FIGS. 4 and 5, it can be seen that the downwardly depending flange 15 curves inwardly towards the circular groove 13 providing a reduced area, indicated in general by numeral 22 that is intended to fit over the top of the can peripheral edge, indicated by numeral 23 in FIG. 5. Inasmuch as the flange is flexible due to the composition of the cover body, the flange will expand or spread slightly when the peripheral can edge 23 is forced into the area 22. Thus, the improved seal is provided for reclosure by the user. Also, it is to be noted that the groove 13 is on the exterior of the cover body so that it will nest with the downwardly projecting element 24, as shown in FIG. 5.

FIG. 5 shows the bottom element 24 to be of a circular configuration and that it is adapted to occupy the recess 13, as illustrated in broken lines. Therefore, the lid body 12 permits stacking of a plurality of cans on top of one another for storage, shipment of transportation purposes. The mechanism for exposing the opening 21 is of a conventional lever type and is illustrated in general by the numeral 25.

If desired, a lifting tab may be incorporated into the flange 18 as illustrated in FIG. 2 by numeral 26. Such a tab may be grasped by the finger of the user and lifted in order to initially remove the body cover from the top of the can. A detent may also be incorporated into the tab 26 which offers resistance to opening so that the cover or lid will not be inadvertently separated from its sealing position on the can. Therefore, it can be seen that the hygienic seal and cover is hingeably carried on the can so as to permit opening and reclosing without separation from the can. Also, a tighter seal is provided by means of the flange 15 and that a straw opening 18 is provided for accommodating the straw. The cover body or lid permits stackability for a plurality of cans because of the annular groove 13 and the tab 26 provides a convenience for opening and access to the opening 21.

FIG. 4 illustrates a superior sealing means by providing flange 15 with a terminating edge projecting into space or area 22 towards an opposing surface of a wall 30. The flange is normally biased towards the wall 30 to provide a yieldable, but tight, seal with the top of can 11. The sealing means is of an inverted in cross-sections having an opening into area 22 for insertably receiving the top edge of the can.

Figure 6:
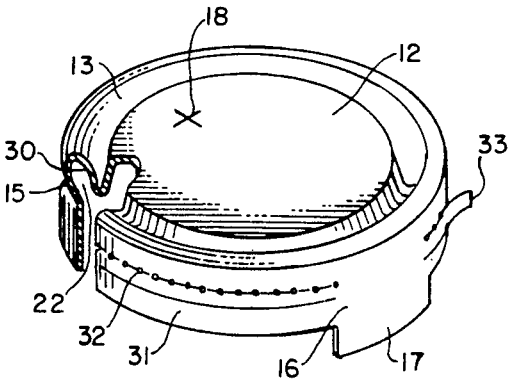
FIG. 6 is a view similar to the view of FIG. 4 illustrating another version of the invention having a tear-strip.

FIG. 6 shows that an attachment band 31 is placed about the can top and that a tearstrip 32 couples the band 31 to the flange 15 during storage. When stripped off by pulling on release portion or tab 33, only the hinge 16 remains to connect the flange with the band. Also, perforations may be employed in place of the tearstrip so that the user can simply punch out the thin portion between perforations to separate the band from the lid flange.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A recloseable cover attached to a pull-tab metallic beverage can comprising:

a cover body having a lid and a peripheral downward depending sidewall for encasing a top of the can to insure sterility prior to use;

hinge means depending from said sidewall for permitting said cover body to be pivoted from the can top for access to the can contents;

said cover body having an inner wall, said sidewall and said inner wall defining a sealing area therebetween;

said cover body having a detent tab in fixed spaced relationship to said hinge means intended to be grasped by the user;

said lid further having a weakened portion breakable by insertion of a straw therethrough;

said cover body further including attachment means coupled to said sidewall for joining said hinge means to the can for securement therebetween;

an arcuate portion joining said sidewall and said inner wall to define an inverted U-shaped cross-section; and said attachment means defining a tearstrip which is removable to separate said attachment means from said sidewall of said cover body.

* * * * *